US007172458B2

(12) United States Patent
Van Der Mee et al.

(10) Patent No.: US 7,172,458 B2
(45) Date of Patent: Feb. 6, 2007

(54) ADAPTER FOR A MULTI-CONTACT CONNECTOR, AND SUCH A CONNECTOR

(75) Inventors: Marnix Van Der Mee, Montlouis sur Loire (FR); Henri Perrin, Chateau-Renault (FR); Armel Baldyrou, Monthodon (FR)

(73) Assignee: Radiall, Rosny Sous Bois (FR)

( * ) Notice: Subject to any disclaimer, the term of this patent is extended or adjusted under 35 U.S.C. 154(b) by 0 days.

(21) Appl. No.: 11/304,762

(22) Filed: Dec. 16, 2005

(65) Prior Publication Data

US 2006/0134990 A1 Jun. 22, 2006

(30) Foreign Application Priority Data

Dec. 16, 2004 (FR) ..... 04 53023

(51) Int. Cl.
*H01R 33/945* (2006.01)

(52) U.S. Cl. ..... 439/577

(58) Field of Classification Search ..... 439/577, 439/364

See application file for complete search history.

(56) References Cited

U.S. PATENT DOCUMENTS 4,993,803 A * 2/1991 Suverison et al. ..... 385/88
5,242,315 A * 9/1993 O'Dea ..... 439/577
5,295,866 A 3/1994 Kroger et al.
6,394,661 B1 5/2002 Cull et al.
6,719,461 B2 * 4/2004 Cull ..... 385/71
6,827,597 B1 12/2004 Metzbower et al.

FOREIGN PATENT DOCUMENTS

DE 31 12078 A1 10/1982
EP 0 427 613 A1 5/1991
EP 0 847 107 A1 6/1998
EP 1 006 379 A2 * 6/2000

* cited by examiner

*Primary Examiner*—Tho D. Ta
(74) *Attorney, Agent, or Firm*—Oliff & Berridge, PLC

(57) ABSTRACT

An adapter may be for a multi-contact connector including at least one insert including at least two cavities. The adapter may include a first face configured to be pressed against a front face of the insert, and a second face opposite from the first face, a plurality of cells extending from the first face to the second face. The cells may include at least one cell of a first type configured to be placed in line with a first of the cavities of the insert and to receive an alignment sleeve configured to co-operate with a ferrule of an optical contact element when engaged in the first cavity, and at least one cell of a second type configured to be disposed in line with a second of the cavities so as to receive an end portion of a female electrical contact element when engaged in the second cavity.

22 Claims, 3 Drawing Sheets

ADAPTER FOR A MULTI-CONTACT CONNECTOR, AND SUCH A CONNECTOR

This non provisional application claims the benefit of French Application No. 04 53023 filed on Dec. 16, 2004

The present invention relates to an adapter for a multi-contact connector, and to such a connector, as used in particular in the aviation and/or military fields, and more generally in any severe environment.

BACKGROUND

At present, there exist optical connectors of the type comprising a housing that receives an insert, the insert having a plurality of cavities, each for receiving a respective optical contact element. An additional part, sometimes called a "sleeve holder" is fastened to the insert, said additional part having a plurality of cells each extending in line with a respective cavity in the insert. Each cell holds an alignment sleeve for the ferrules of two optical contact elements that are to be connected together.

That prior art type of connector is exclusively optical and could be a connector of the LuxCis (registered trademark) range sold by the supplier Radiall.

In certain apparatuses, electrical connections are needed as well as optical connections.

SUMMARY

The invention seeks to simplify the provision of electrical and optical connections for that type of apparatus.

The invention thus provides an adapter for a multi-contact connector of the type including at least one insert, the insert having at least two cavities, a first of said cavities being capable of receiving at least part of an optical contact element and a second of said cavities being suitable for receiving at least part of a female electrical contact element, the insert presenting a front face into which said at least two cavities open out, the adapter being arranged to be disposed, preferably in releasable manner, on said front face of the insert, and comprising:

at least one cell of a first type arranged to be placed in line with a first of said cavities of the insert and to receive an alignment sleeve, in particular a split sleeve, suitable for co-operating with a ferrule of an optical contact element engaged in said first cavity of the insert; and at least one cell of a second type arranged to be disposed in line with a second of said cavities of the insert so as to receive an end portion of a female electrical contact element engaged in said second cavity of the insert.

The adapter of the invention enables a connector originally designed for making optical connections only to be transformed into a combined optical and electrical connector.

For example, with a connector of the above-mentioned LuxCis range, the sleeve-holder part has cells that are adapted to optical contact elements.

That connector cannot be used for making electrical connections since they involve male and female electrical contact elements.

By providing an adapter of the invention, with at least some of the cells being capable of receiving a female electrical contact element, it becomes possible with existing inserts to provide, at low cost, combined connectors providing both optical and electrical connections.

By means of the invention, it is possible to avoid using two separate connectors, one optical and the other electrical.

The cells of the first and second types respectively may present different shapes and/or dimensions, for example.

The cell of the second type is arranged in particular so as to be capable of receiving firstly a female electrical contact element via the first face of the adapter, and secondly at least part of a male electrical contact element for connection with the female contact element, via the second face of the adapter, the male contact element projecting beyond the second face of the adapter out from the cell, at the end of connection with the female contact element.

Preferably, the adapter has a first face, a substantially plane face, for pressing against the front face of the insert, and a second face, in particular a substantially plane face, opposite from the first, with the cells extending from the first face and second face of the adapter.

In an embodiment of the invention, the cell of the second type is connected to a tubular portion projecting from the second face. In a variant, each cell of the second type opens out into the second face.

Advantageously, the cell of the second type has an internal shoulder, in particular an annular shoulder.

The shoulder serves in particular as an abutment for the female contact element and to provide the inlet of the female contact element with mechanical protection and to align the male contact element on being inserted into the female contact element.

In an embodiment of the invention, the cell of the second type presents at least one cylindrical inside wall.

The cell of the second type may open out into the first face of the adapter.

The cells of the adapter are preferably distinct, in particular being separated from one another over their entire lengths between the first and second faces of the adapter.

Where appropriate, the adapter may include at least two cells of the first type and/or at least two cells of the second type.

In an embodiment of the invention, the cell of the first type includes at least one holder lip, and in particular two holder lips, each disposed at a respective end of the cell, said lip(s) optically being elastically deformable, and in particular being annular, being arranged to hold an alignment sleeve when inserted in the cell.

The cell of the first type may be connected at its ends to tubular portions projecting respectively from the first and second faces of the adapter.

In a variant, the cell of the first type opens out into the first and second faces of the adapter.

The first and second faces of the adapter may be substantially rectangular, or in a variant they may each being disk-shaped.

The adapter may comprise two assembled-together elements, one defining the first face and the other defining the second face of the adapter.

It is preferably made out of at least one electrically insulating material, in particular a plastics material.

In an embodiment of the invention, the adapter includes a socket for receiving a fastener element for fastening the adapter to the insert, the socket being disposed in particular in a central location of the adapter. The fastener element may be pre-assembled with the adapter.

The invention also provides a connector comprising:

at least one insert having at least two cavities, a first of said cavities being capable of receiving at least part of an optical contact element, and a second of said cavities being capable of receiving at least part of a female electrical contact element, the insert presenting a front face into which said at least two cavities open out; and at least one adapter arranged to be disposed, preferably in releasable manner, on said front face of the insert, the adapter including:

at least one cell of a first type arranged to be disposed in line with a first of said cavities of the insert and to receive an alignment sleeve suitable for co-operating with a ferrule of an optical contact element engaged in said cavity of the insert; and at least one cell of a second type arranged to be disposed in line with one of said second cavities of the insert in such a manner as to receive an end portion of a female electrical contact element engaged in said second cavity of the insert.

The connector may include an outer housing in which said at least one insert is received.

The housing may present at least one cross-section that is rectangular or that is circular.

The connector may include:

in one of the cells of the first type, at least one alignment sleeve, in particular a split sleeve, said sleeve being capable of receiving a ferrule of an optical contact element; and/or in one of the cells of the second type, a female electrical contact element, said female electrical contact element being capable of receiving a male electrical contact element.

The connector element may be arranged to be coupled with a complementary connector or with a conventional socket. Said complementary connector or said socket includes one or more male electrical contact elements suitable for engaging in cells of the second type in the adapter and in corresponding female electrical contact elements of the connector of the invention.

In order to obtain a connector that is exclusively optical, it is possible in conventional manner to fasten an existing sleeve-holder part on the insert.

Advantageously, the adapter includes at least one fastener element for fastening the adapter to the insert, the fastener element preferably being fitted to the insert and comprising, for example, a threaded element such as a screw.

The invention also provides a method of making optical and electrical connections using a first connector having a first insert with cavities, a second connector suitable for being coupled to the first, having a second insert with cavities, and an adapter as specified above, the method comprising the following steps:

fastening the adapter to one of the first and second inserts;

mounting optical contact elements and female electrical contact elements in one of the inserts;

mounting optical contact elements and male electrical contact elements in the other one of the inserts; and coupling the connectors together in such a manner that the adapter is sandwiched between the inserts, and establishing optical and electrical connections between the connectors.

The first and second inserts may be standard.

BRIEF DESCRIPTION OF THE DRAWINGS

The invention can be better understood on reading the following detailed description of non-limiting embodiments of the invention, and on examining the accompanying drawings, in which.

MORE DETAILED DESCRIPTION

Figure 1:
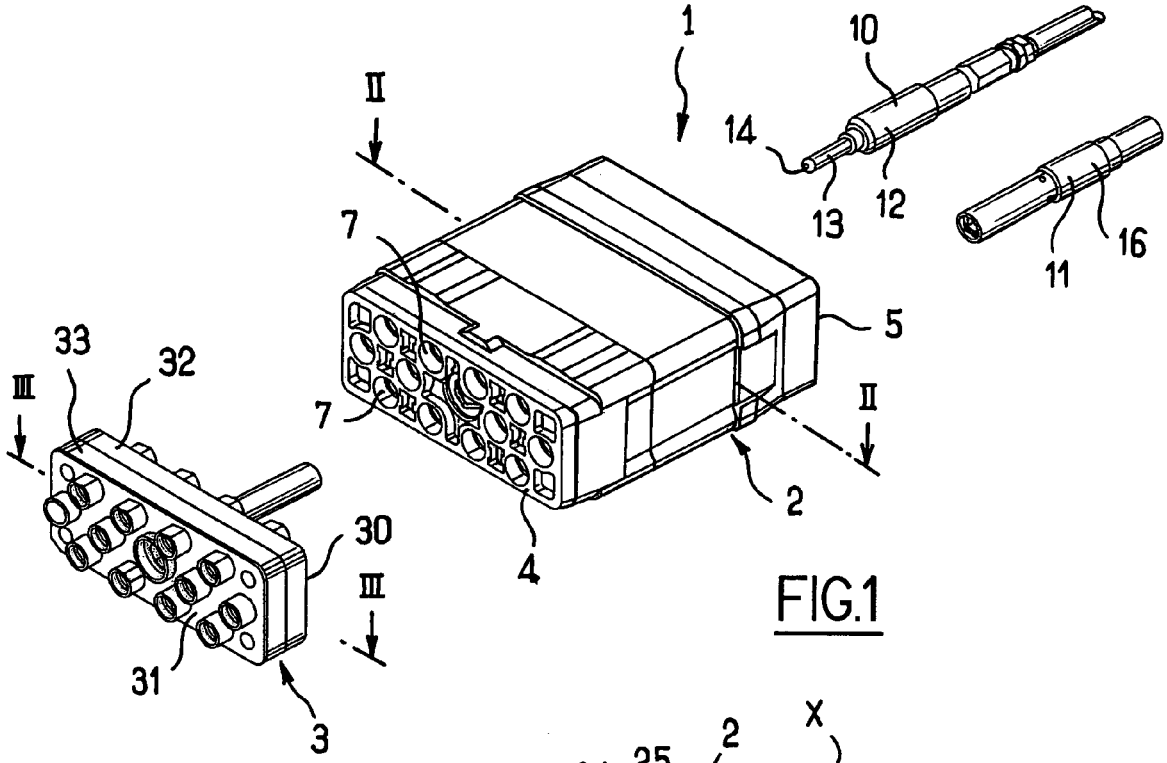
FIG. 1 is a diagrammatic and fragmentary perspective view showing various elements of a connector in accordance with the invention.

FIG. 1 shows the various elements of a connector in accordance with the invention given overall reference 1, and comprising an insert 2 and an adapter 3.

The insert 2 is generally in the form of a rectangular block with front and rear faces 4 and 5.

The insert 2 further includes a plurality of cavities 7 extending parallel to an axis X between the rear and front faces 5 and 4.

In the example described, the cavities 7 are all identical. In a variant, it is possible to provide an insert 2 having at least two cavities of different shapes.

Figure 2:
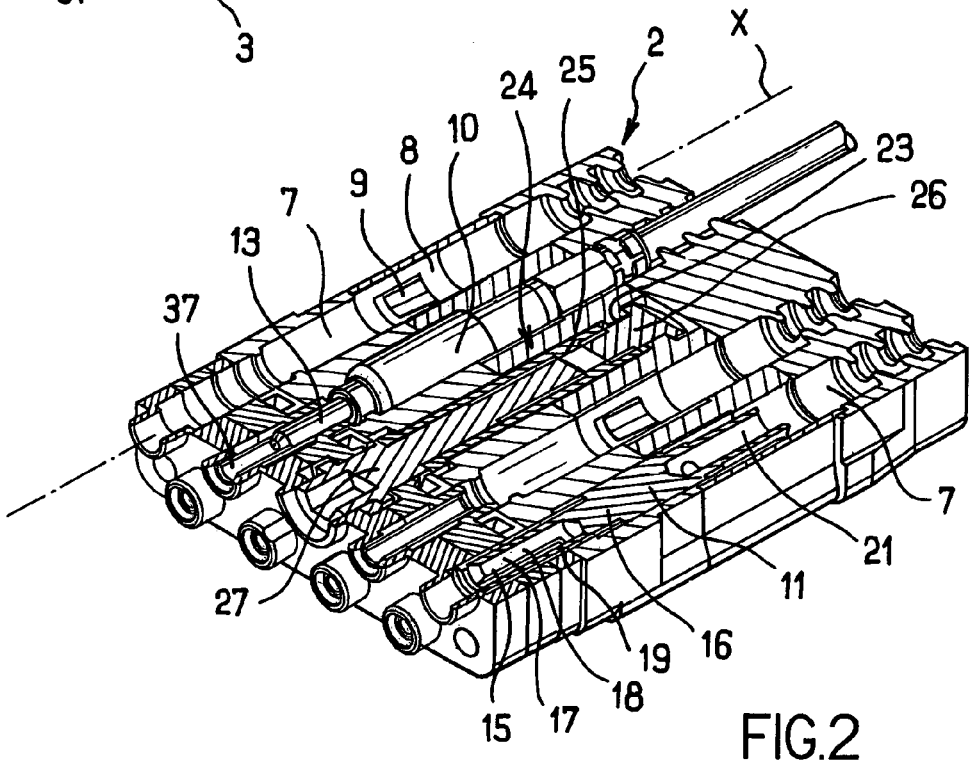
FIG. 2 is a diagrammatic and fragmentary section view on II—II of the FIG. 1 elements, once assembled.

Each cavity 7 receives a holder ring 8 provided with one or more elastically deformable tabs 9, as shown in FIG. 2.

The insert 2 further includes a hole 23 suitable for receiving fastener elements 24 of the adapter 3 in the insert 2.

These fastener elements 24 comprise, for example, a sleeve 25 having an inside thread suitable for receiving at a first end a first screw 26 and at an opposite end a second screw 27.

The cavities 7 can receive equally well an optical contact element 10 or a female electrical contact element 11.

Each optical contact element 10 comprises a body 12 having a ferrule 13 carrying an optical fiber 14 mounted therein.

The ferrule 13 is mounted in the body 12 so as to be capable of floating axially.

The insert 2 and the optical contact elements 10 may be of the same type as those used in connectors of the LuxCis range sold by the supplier Radiall, in particular connectors of types EPXA and B.

Figure 4:
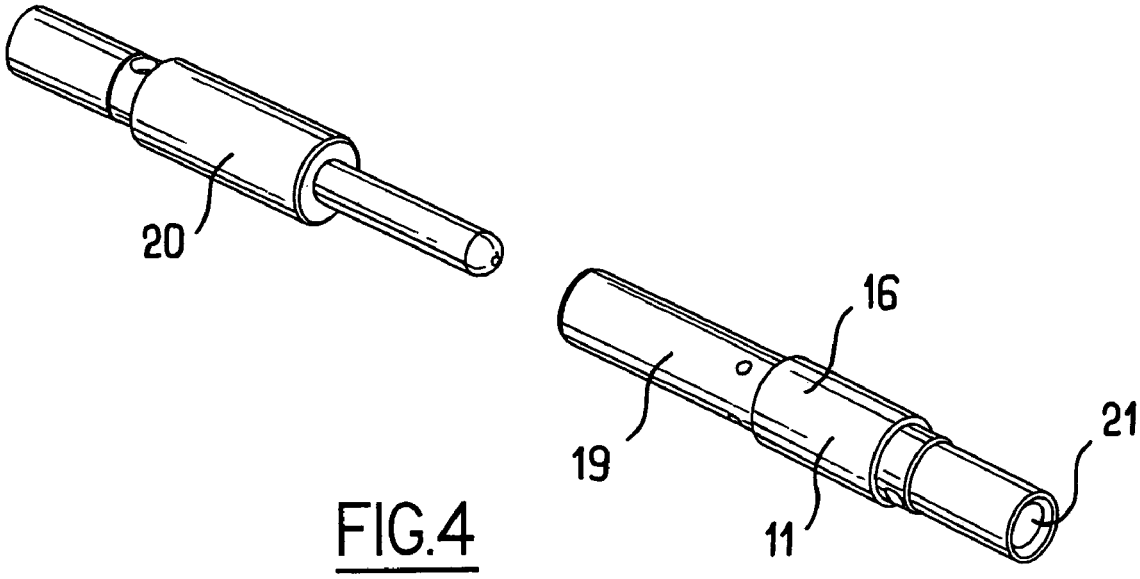
FIG. 4 is a diagrammatic and fragmentary perspective view of a female electrical contact element and of a male electrical contact element.

The female electrical contact element 11 comprises an electrically conductive body 16, having an end portion 15 formed by elastically deformable tabs 17 and defining a socket 18 for receiving a male electrical contact element 20, as can be seen in FIGS. 2 and 4, in particular.

A sleeve 19 is inserted around the body 16, level with the tabs 18.

At its end remote from the portion 15, the body 16 presents an additional socket 21 serving to crimp one or more strands of an electric cable to the contact element 11.

The adapter 3 of the invention presents a first face 30 for pressing against the front face 4 of the insert 2, and a second face 31 opposite from the first face 30.

In the example described, the faces 30 and 31 are substantially plane and present a shape that is substantially rectangular.

The adapter 3 comprises two assembled-together elements 32 and 33, the element 32 defining the first face 30 and the element 33 defining the second face 31.

In the example described, the elements 32 and 33 are made of an electrically insulating material, in particular a plastics material.

Figure 3:
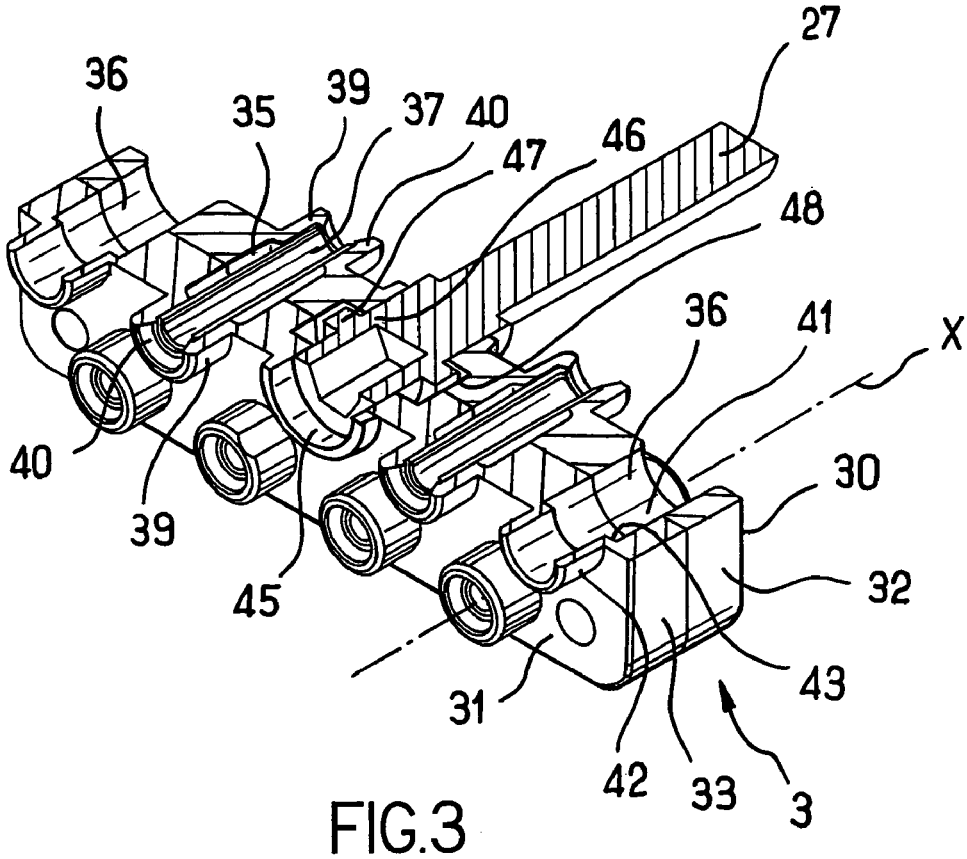
FIG. 3 is a diagrammatic and fragmentary section view on III—III of the adapter shown in FIG. 1.

The adapter 3 has a plurality of cells 35 of a first type, each for receiving a respective conventional split alignment sleeve 37 suitable for co-operating with a ferrule 13 of an optical contact element 10, as shown in FIG. 3.

Each cell 35 has a holder lip 40 suitable for holding the alignment 37 in the cell 35.

Each holder lip 40 is made on a tubular portion 39 projecting from the first face 30 or from the second face 31.

The adapter 3 also has a plurality of cells 36 of a second type.

Each cell 36 presents an internal cylindrical wall 41 of axis X connected to a tubular portion 42 of smaller inside diameter projecting from the front face 31 of the adapter 3 as can be seen in FIG. 3.

Each cell 36 presents an inside shoulder 43 at the base of the tubular portion 42, extending substantially perpendicularly to the axis X.

Each cell 36 opens out directly into the first face 30.

Each of the cells 35 and 36 is located so as to be disposed in register with a corresponding cavity 7 of the insert 2.

In the example described, the cells of the first type 35 and the cells of the second type 36 are both six in number, the cells being disposed in three rows of four cells each.

In a variant, the cells 35 and 36 can be in smaller or larger numbers, it being possible for the adapter 3 to have a single cell 35 and a single cell 36.

The adapter 3 presents a socket 45 suitable for receiving the head 46 of the screw 27.

In the example described, the socket 45 is located in a central location of the adapter 3.

The head 46 presents a collar 47 held captive in a shouldered portion 48 of the socket 45.

The head 46 of the screw 27 can be put into place in the socket 45 when the elements 32 and 33 of the adapter are being assembled together.

The adapter 3 is assembled with the insert 2 by screwing the screw 27 into the sleeve 25.

After assembly, an optical contact element 10 can be inserted into a cavity 7 associated with a cell 35 of the first type in such a manner that the ferrule 13 of the optical contact element 10 is engaged in the sleeve 37, as can be seen in FIG. 2.

It is possible to insert a female electrical contact element 11 in a cavity 7 associated with a cell 36 of the second type, in such a manner as to enable the end 15 of the contact element to engage in the cell 36.

The connector 1 is designed for coupling to a complementary connector (not shown) having an insert identical to the insert 2 and receiving optical contact elements and male electrical contact elements.

It would not go beyond the ambit of the present invention for the adapter to be used with a circular connector.

Figure 5:
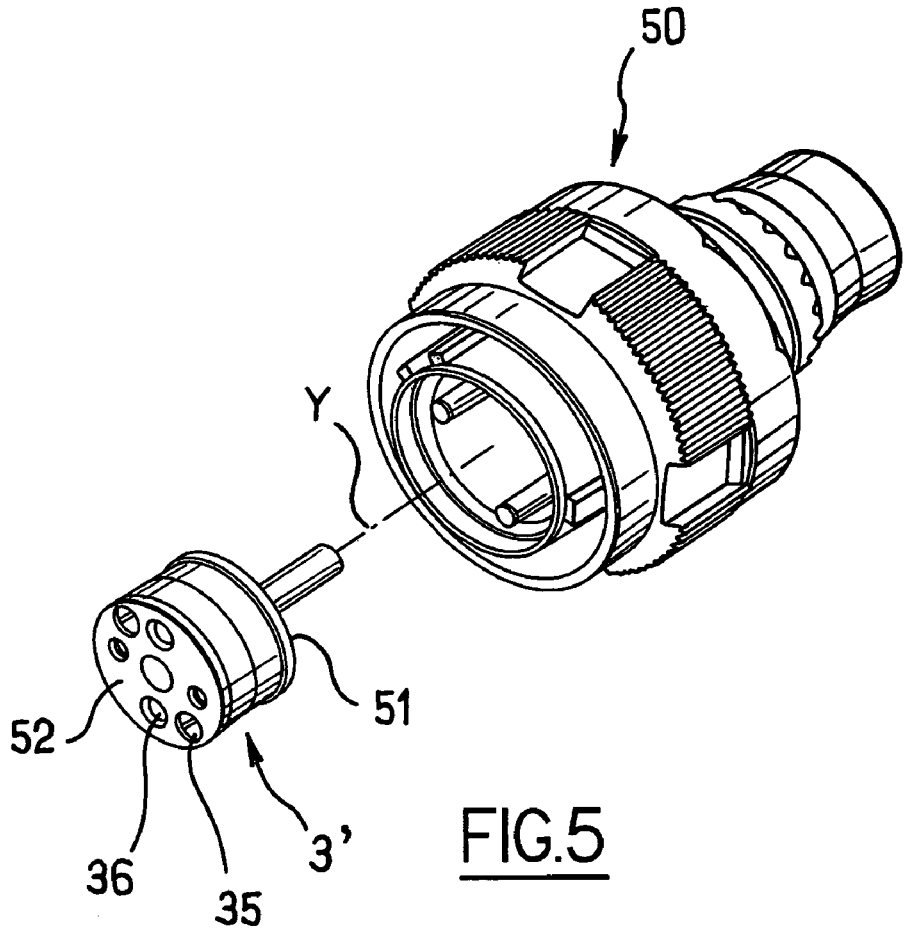
FIG. 5 is a diagrammatic and fragmentary perspective view of two elements of a connector in accordance with another embodiment of the invention.
Figure 6:
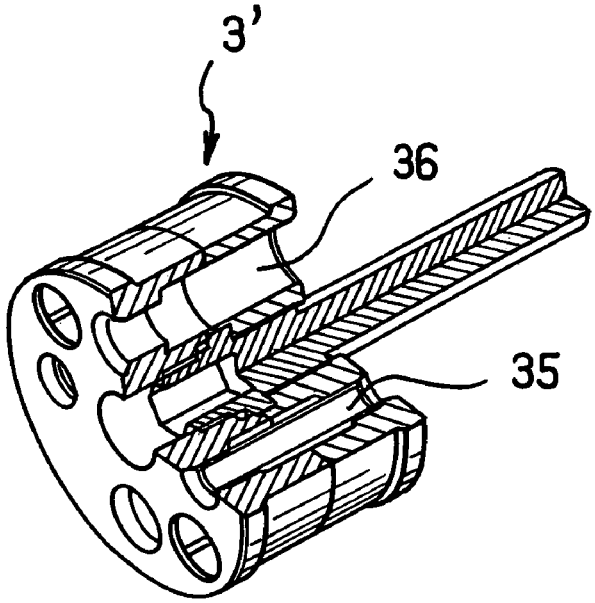
FIG. 6 is a partially cutaway diagrammatic and fragmentary view of the adapter of the FIG. 5 connector.

FIGS. 5 and 6 show an adapter 3' used with a circular connector or plug 50 of conventional type arranged for plugging into a receptacle (not shown).

The connector 50 may be of the MIL-DTL-3899 series III type as sold by the supplier Radiall.

The adapter 3' presents a cross-section that is circular.

In the example described, the adapter has two cells 35 of the first type and two cells 36 of the second type disposed around the axis of symmetry Y of the adapter 3'. These cells 35 and 36 open out into first and second disk-shaped faces 51 and 52 of the adapter 3'.

Naturally, the invention is not limited to the embodiments described above.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An adapter for a multi-contact connector including at least one insert, the insert including at least two cavities, a first of said cavities being configured to receive at least part of an optical contact element and a second of said cavities being configured to receive at least part of a female electrical contact element, the insert including a front face into which said at least two cavities open, the adapter being configured to be disposed on said front face of the insert, and comprising:

a first face configured to be pressed against the front face of the insert, and a second face opposite from the first face, a plurality of cells extending from the first face to the second face of the adapter;

the plurality of cells including at least one cell of a first type configured to be placed in line with a first of said cavities of the insert and to receive an alignment sleeve configured to co-operate with a ferrule of an optical contact element when engaged in said first cavity of the insert, at least one cell of a second type configured to be disposed in line with a second of said cavities of the insert so as to receive an end portion of a female electrical contact element when engaged in said second cavity of the insert;

and the cell of the second type being connected to a tubular portion that at least one of projects from the second face and opens in the second face.

2. An adapter according to claim 1, wherein at least one of the first face and the second face comprises a substantially planar face.

3. An adapter according to claim 1, wherein the cell of the second type includes an internal shoulder.

4. An adapter according to claim 1, wherein the cell of the second type includes at least one cylindrical inside wall.

5. An adapter according to claim 1, wherein the cell of the second type opens into the first face of the adapter.

6. An adapter according to claim 1, further comprising at least two cells of at least one of the first type and the second type.

7. An adapter according to claim 1, wherein the cell of the first type includes at least one holder lip disposed at an end of the cell, said lip being configured to hold an alignment sleeve when inserted into said cell.

8. An adapter according to claim 1, wherein the cell of the first type is connected at each end thereof to tubular portions that project from the first and second faces of the adapter, respectively.

9. An adapter according to claim 1, wherein the cell of the first type opens into the first and second faces of the adapter.

10. An adapter according to claim 1, wherein the first and second faces of the adapter are substantially rectangular.

11. An adapter according to claim 1, wherein the first and second faces are each in the form of a disk.

12. An adapter according to claim 1, wherein the adapter is made of at least one electrically insulating material.

13. An adapter according to claim 1, further comprising a socket configured to receive a fastener element configured to fasten the adapter to the insert.

14. An adapter according to claim 1, comprising two assembled-together elements, a first of the elements defining the first face and a second of the elements defining the second face of the adapter.

15. An adapter according to claim 1, wherein the cells are separated from one another over entire lengths thereof between the first and second faces of the adapter.

16. A connector, comprising:

at least one insert including at least two cavities, a first of said cavities being configured to receive at least part of an optical contact element, and a second of said cavities being configured to receive at least part of a female electrical contact element, the insert including a front face into which said at least two cavities open; and at least one adapter as defined in claim 1.

17. A connector according to claim 16, further comprising an outer housing in which said at least one insert is received.

18. A connector according to claim 17, wherein the housing includes at least one cross-section that is rectangular.

19. A connector according to claim 17, wherein the housing includes at least one cross-section that is circular.

20. A method of making optical and electrical connections using a first connector comprising a first insert with cavities, a second connector configured to be coupled to the first, comprising a second insert with cavities, and an adapter according to claim 1, the method comprising:

fastening the adapter to one of the first and second inserts;

mounting optical contact elements and female electrical contact elements in one of the first and second inserts;

mounting optical contact elements and male electrical contact elements in the other of the first and second inserts; and coupling the connectors together to sandwich the adapter between the inserts, and to establish optical and electrical connections between the connectors.

21. An adapter for a multi-contact connector including at least one insert, the insert including at least two cavities, a first of said cavities being configured to receive at least part of an optical contact element and a second of said cavities being configured to receive at least part of a female electrical contact element, the insert including a front face into which said at least two cavities open, the adapter being arranged to be disposed on said front face of the insert, and comprising:

a first face configured to be pressed against the front face of the insert, and a second face opposite from the first face, a plurality of cells extending from the first face to the second face of the adapter;

the plurality of cells including at least one cell of a first type configured to be placed in line with a first of said cavities of the insert and to receive an alignment sleeve configured to co-operate with a ferrule of an optical contact element when engaged in said first cavity of the insert, at least one cell of a second type configured to be disposed in line with a second of said cavities of the insert so as to receive an end portion of a female electrical contact element when engaged in said second cavity of the insert;

and the adapter comprising two assembled-together elements, a first of the elements defining the first face, and a second of the elements defining the second face of the adapter.

22. An adapter for a multi-contact connector including at least one insert, the insert including at least two cavities, a first of said cavities being configured to receive at least part of an optical contact element and a second of said cavities being configured to receive at least part of a female electrical contact element, the insert including a front face into which said at least two cavities open, the adapter being configured to be disposed on said front face of the insert, and comprising:

at least one cell of a first type configured to be placed in line with a first of said cavities of the insert and to receive an alignment sleeve configured to co-operate with a ferrule of an optical contact element when engaged in said first cavity of the insert;

at least one cell of a second type arranged to be disposed in line with a second of said cavities of the insert so as to receive an end portion of a female electrical contact element when engaged in said second cavity of the insert; and at least one fastener element configured to fasten the adapter to the insert and comprising at least one screw.

* * * * *